US008378901B2

(12) United States Patent
Wu et al.

(10) Patent No.: US 8,378,901 B2
(45) Date of Patent: Feb. 19, 2013

(54) HANDHELD ELECTRONIC DEVICE

(75) Inventors: Wei-Yang Wu, Taoyuan (TW); Ying-Cong Deng, Taoyuan (TW); Chung-Ting Hung, Taoyuan (TW); Kuo-Cheng Chen, Taoyuan (TW)

(73) Assignee: HTC Corporation, Taoyuan, Taoyuan County (TW)

( * ) Notice: Subject to any disclaimer, the term of this patent is extended or adjusted under 35 U.S.C. 154(b) by 500 days.

(21) Appl. No.: 12/694,432

(22) Filed: Jan. 27, 2010

(65) Prior Publication Data

US 2010/0315300 A1 Dec. 16, 2010

(30) Foreign Application Priority Data

Jun. 15, 2009 (TW) ..... 98119958 A

(51) Int. Cl.
*H01Q 1/24* (2006.01)

(52) U.S. Cl. ..... 343/702; 343/841

(58) Field of Classification Search ..... 343/702, 343/741, 846; 381/315, 322
See application file for complete search history.

(56) References Cited

U.S. PATENT DOCUMENTS

| | | | | |
|---|---|---|---|---|
| 6,366,247 | B1 | 4/2002 | Sawamura et al. | |
| 6,697,025 | B2 * | 2/2004 | Koyanagi et al. | 343/741 |
| 2002/0018021 | A1 | 2/2002 | Koyanagi et al. | |
| 2004/0090372 | A1 * | 5/2004 | Nallo et al. | 343/700 MS |
| 2004/0164910 | A1 * | 8/2004 | Kuroda | 343/702 |
| 2005/0007292 | A1 | 1/2005 | Lee et al. | |
| 2006/0140428 | A1 | 6/2006 | Qi et al. | |
| 2008/0158065 | A1 | 7/2008 | Wee | |
| 2009/0111541 | A1 | 4/2009 | Kim et al. | |
| 2009/0124306 | A1 | 5/2009 | Kim et al. | |
| 2010/0052998 | A1 | 3/2010 | Teng et al. | |

FOREIGN PATENT DOCUMENTS

| | | | |
|---|---|---|---|
| CN | 1284762 | A | 2/2001 |
| EP | 1 788 663 | A1 | 5/2007 |
| EP | 2161779 | A1 | 3/2010 |
| WO | WO-02/21633 | A1 | 3/2002 |
| WO | WO 2007/039071 | A2 | 4/2007 |

* cited by examiner

*Primary Examiner* — Hoanganh Le
(74) *Attorney, Agent, or Firm* — Rabin & Berdo, P.C.

(57) ABSTRACT

A handheld electronic device comprises a housing, a receiver, a balance antenna and a body. The housing comprises a top end and a bottom end. The receiver is located in the housing and near the top end, and the balance antenna is located in the housing and near the bottom end. The body is located in the housing and electrically couples to the receiver and the balance antenna.

8 Claims, 6 Drawing Sheets

HANDHELD ELECTRONIC DEVICE

This application claims the benefit of Taiwan application Serial No. 98119958, filed Jun. 15, 2009, the subject matter of which is incorporated herein by reference.

BACKGROUND OF THE APPLICATION

1. Field of the Application

The application relates in general to a handheld electronic device and more particularly to a handheld electronic device for reducing electromagnetic interference.

2. Description of the Related Art

When being operated by a user, a mobile phone radiates signals around its receiver which might interfere with a hearing aid. In this regard, federal communications commission (FCC), according to which the mobile phone is requested to be tested for its compatibility with the hearing aid, establishes an act associated with hearing aid compatibility (HAC), so as to evaluate the adaptability and safety between the hearing aid and diverse communication apparatuses.

TABLE 1

| Level | Regulation of Electric Field Strength (V/m) | Regulation of Magnetic Field Strength (A/m) |
|---|---|---|
| M1 | 149.6-266.1 | 0.45-0.8 |
| M2 | 84.1-149.6 | 0.25-0.45 |
| M3 | 47.3-84.1 | 0.15-0.25 |
| M4 | <33.5 | <0.15 |

Referring to Table 1, according to the HAC act, manufactories of the mobile phone have to make the electromagnetic interference (EMI) of the mobile phone under a threshold value. The mentioned EMI can be categorized into the disturbances of electric field and magnetic field that affect the performance and endurability of hearing aid. In other words, HAC is provided to deal with not only the influence of electric field on the hearing aid, but also the disturbance of magnetic field on the hearing aid. Moreover, according to the FCC, the mobile phone is requested to comply with the level of M3 listed in table 1. That is, the electric field strength of mobile phone has to be lower than 84.1 V/m, and the magnetic field strength of mobile phone has to be lower than 0.25 A/m. Therefore, it is an important issue of the industrial endeavors to develop a mobile phone which complies with HAC act.

SUMMARY OF THE APPLICATION

The application is directed to a handheld electronic device, which at least includes the following advantages of:

1. lowering an induced current on the substrate; and
2. complying with the hearing aid compatibility (HAC).

According to an aspect of the present application, a handheld electronic device is provided. The handheld electronic device includes a housing, a receiver, a balance antenna and a body. The housing includes a top end and a bottom end. The receiver is located in the housing and near the top end, and the balance antenna is located in the housing and near the bottom end. The body is located in the housing and is electrically coupled to the receiver and the balance antenna.

The application will become apparent from the following detailed description of the preferred but non-limiting embodiments. The following description is made with reference to the accompanying drawings.

DETAILED DESCRIPTION OF THE APPLICATION

In order to comply with HAC act, a handheld electronic device is provided in the following embodiments functioning wireless and mobile communication. In an embodiment, the handheld electronic device can be referred to as a mobile phone, but this application is not limited thereto. The handheld electronic device includes a housing, a receiver, a balance antenna, and a body. The housing includes a top end and a bottom end. The receiver is located in the housing and near the top end, and the balance antenna is located in the housing and near the bottom end. The body of the handheld electronic device is located in the housing, and is electrically coupled to the receiver and the balance antenna. The embodiment is elaborated below for further description.

Embodiment

Figure 1:
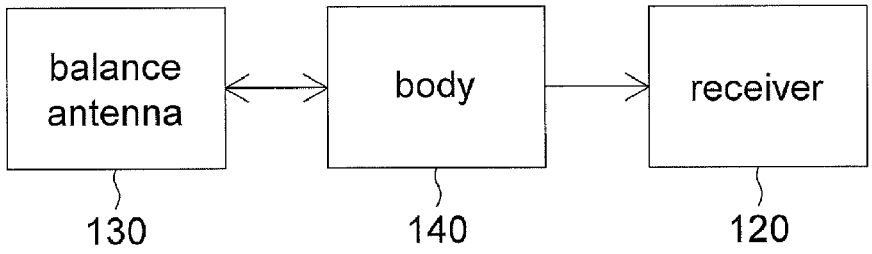
FIG. 1 is a block diagram showing a handheld electronic device according to an embodiment of the application.
Figure 2:
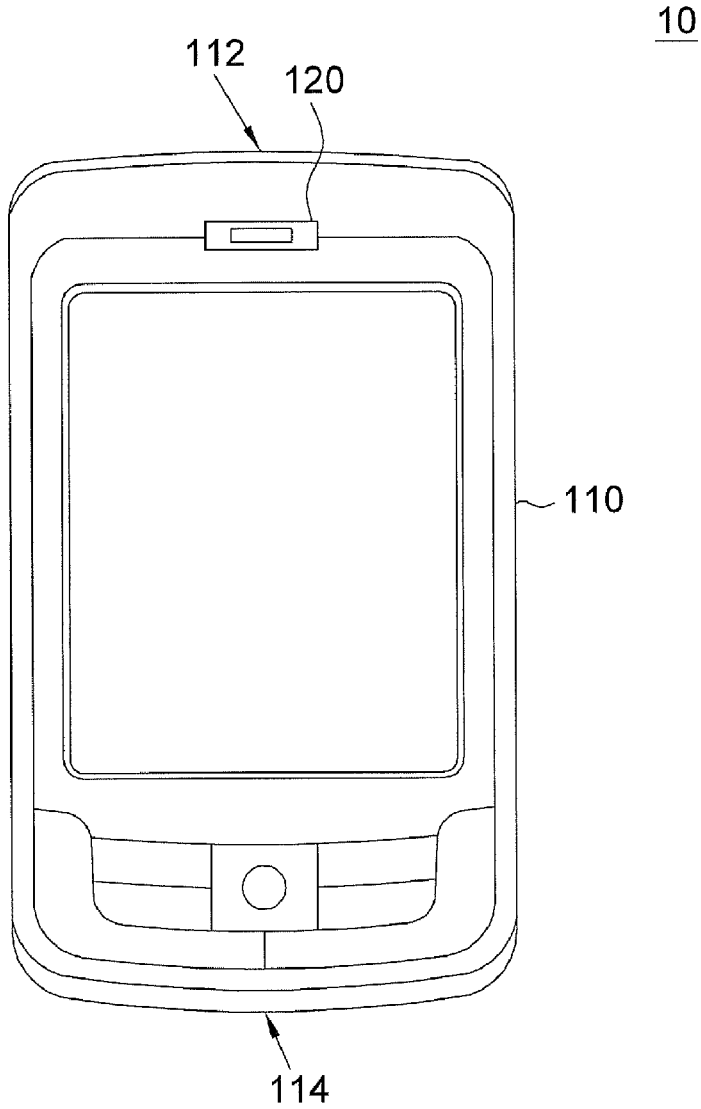
FIG. 2 is a schematic diagram showing a receiver of the handheld electronic device and its location thereon.
Figure 3:
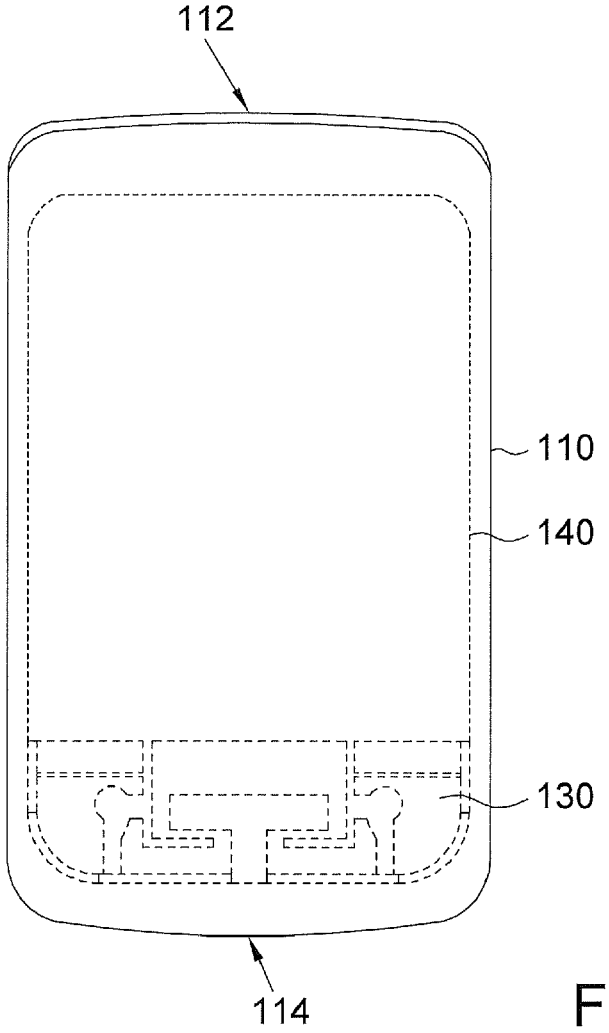
FIGS. 3 and 4 are perspective diagrams showing the handheld electronic device at different angles.
Figure 4:
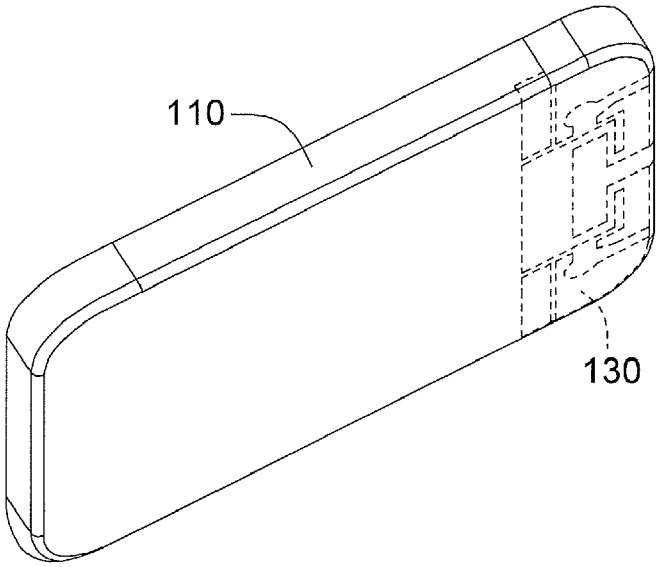
Figure 5:
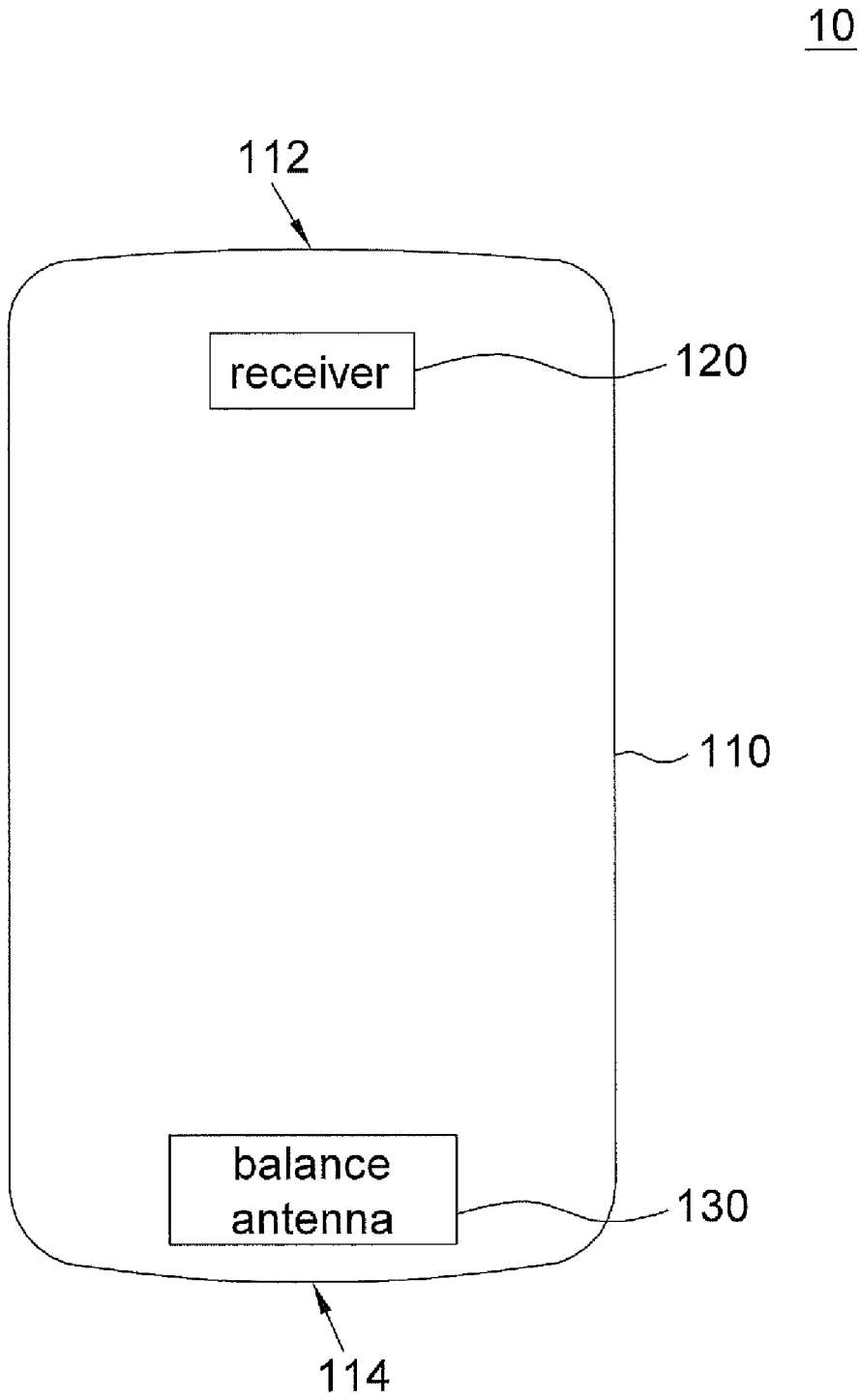
FIG. 5 is a schematic diagram showing the relative arrangement of the receiver and the balance antenna with respect to the handheld electronic device.

Refer to FIGS. 1 to 4. FIG. 1 is a block diagram showing a handheld electronic device according to an embodiment of the application. FIG. 2 is a schematic diagram showing a receiver of the handheld electronic device and its location thereon. FIGS. 3 and 4 are perspective diagrams showing the handheld electronic device at different angles. FIG. 5 is a schematic diagram showing the relative arrangement of the receiver and the balance antenna with respect to the mobile communication device. The handheld electronic device 10 is, for example, a mobile phone, a smart phone, a personal digital assistant (PDA), or a satellite navigation device. The handheld electronic device 10 includes a housing 110, a receiver 120, a balance antenna 130, and a body 140. The balance antenna 130 is located between the housing 110 and the body 140. The receiver 120, the balance antenna 130, and the body 140 are disposed inside the housing 110. The body 140 is coupled to the receiver 120 and the balance antenna 130. The body 140 transmits and receives wireless signals through the balance antenna 130. The received wireless signal of balance antenna 130 is processed by a matching circuit, a radio frequency (RF) circuit, and a series of relevant circuits, and output by the receiver 120. The balance antenna 130 is, for example, a loop antenna with three-dimensional structure. The body 140 of handheld electronic device is, for example, a substrate, on which a number of relevant circuit elements are disposed.

Figure 4A:
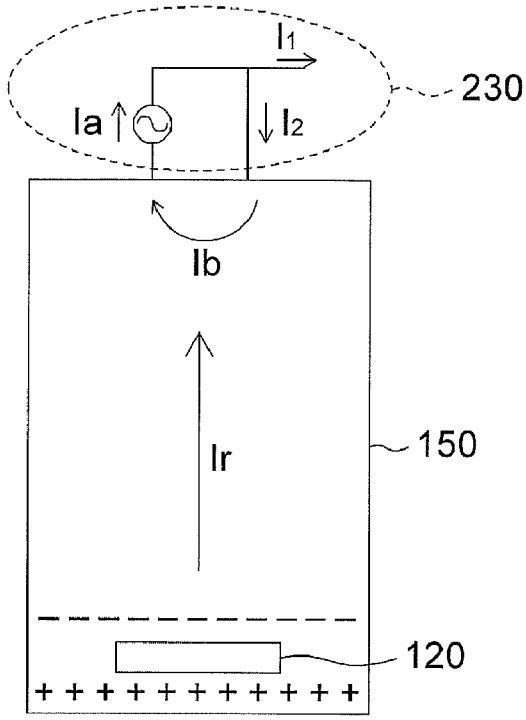
FIG. 4A is a schematic diagram showing the architecture of a non-balance antenna and a substrate.

Referring to FIG. 4A, FIG. 4A is a schematic diagram showing the architecture of a non-balance antenna and a substrate. The non-balance antenna 230 is electrically coupled to the substrate 150. The non-balance antenna 230 has a current $I_a$ inside, wherein $I_a=I_1+I_2$. Because the current $I_1$ does not return to a system ground plane of the substrate 150, the current $I_b$ is not equal to the current $I_a$. In accordance with the principle of conservation of energy, the substrate 150 will generate an induced current $I_r$ correspondingly, with a result of $I_a=I_b+I_r$. Due to the induced current $I_r$ generated inside of the substrate 150, charges are not uniformly distributed at the surrounding area of the receiver 130, and the electric field is influenced, thereby affecting the tests for HAC.

Figure 4B:
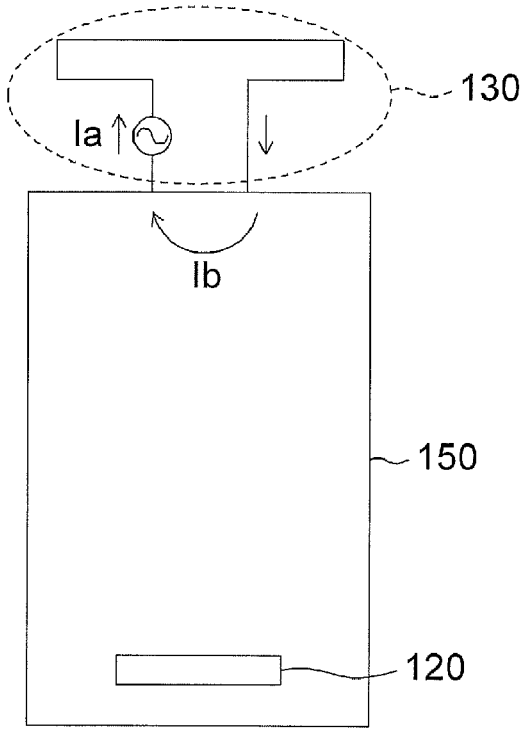
FIG. 4B is a schematic diagram showing the architecture of the balance antenna and the substrate.

Referring to FIGS. 4B and 5, FIG. 4B is a schematic diagram showing the architecture of the balance antenna and the substrate. The balance antenna 130 and the substrate 150 are electrically coupled to each other. The balance antenna 130 has a current $I_a$ inside, wherein $I_a=I_b$, which prevents the substrate 150 from generating the induced current $I_r$. In this way, charge distribution will not be influenced, and the embodiment can comply with HAC act.

The housing 110 further includes a top end 112 and a bottom end 114. The receiver 120 is located in the housing 110 and near the top end 112, and the balance antenna 130 is located in the housing 110 and near the bottom end 114. Because the receiver 120 and the balance antenna 130 are respectively disposed on the top end 112 and the bottom end 114 which are opposite to each other, it is possible to improve the electromagnetic interference between the balance antenna 130 and a hearing aid. Besides, because the current flowing into the balance antenna 130 is equal to the current flowing out of the balance antenna 130, it is further possible to prevent the induced current from being generated on the substrate. In this way, the handheld electronic device 10 can comply with the HAC act established by federal communications commission (FCC).

Figure 6:
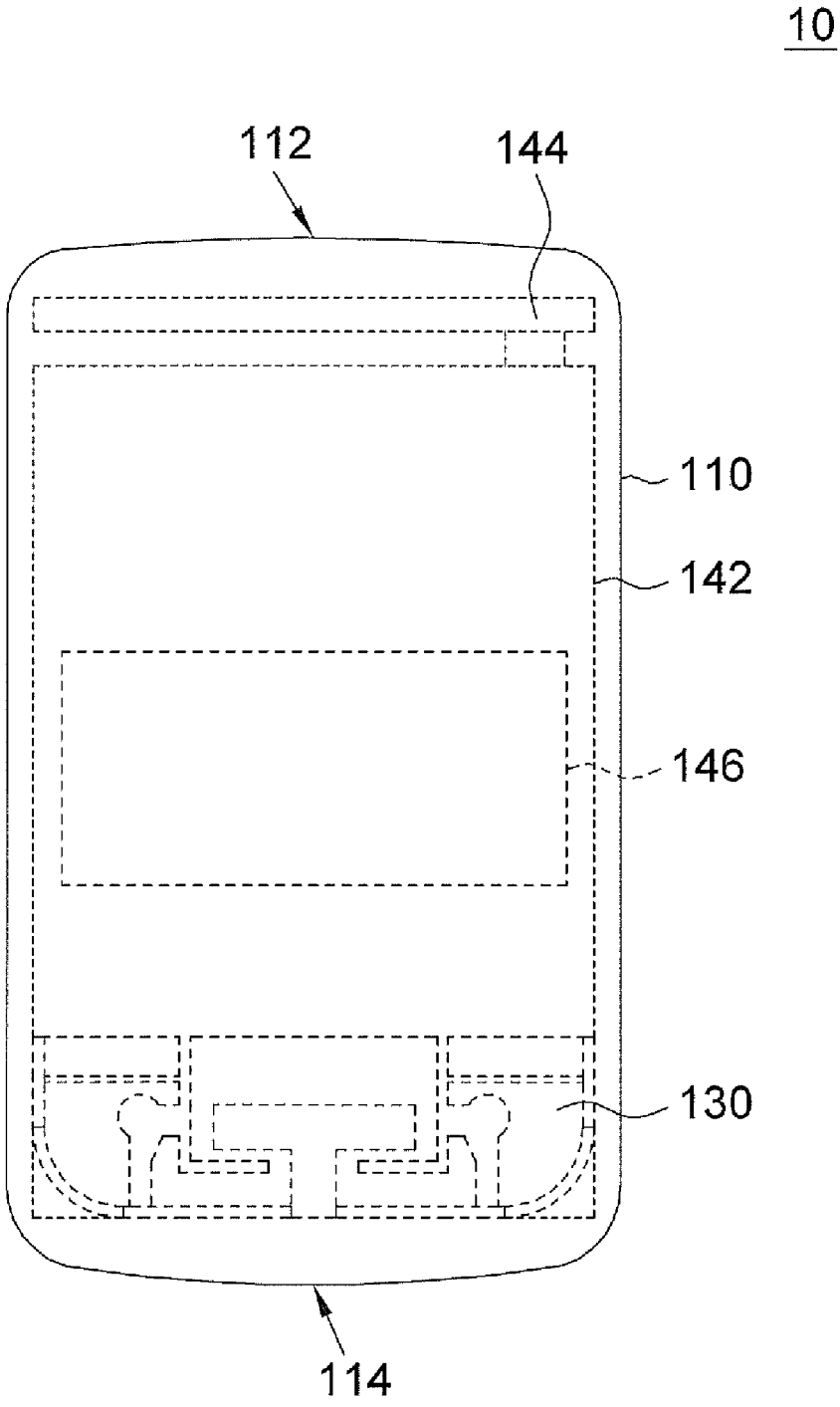
FIG. 6 is a perspective diagram showing a part of the elements of the handheld electronic device.

Referring to FIG. 6, FIG. 6 is a perspective diagram showing a part of the elements of the handheld electronic device. The mentioned body 140 further includes a system ground plane 142, an electricity conduction plate 144, and a absorbor 146. The system ground plane 142 is coupled to a ground portion 133 of the balance antenna 130. The electricity conduction plate 144 is coupled to one side of the system ground plane 142 and near the top end 112, which is for increasing the current density of the system ground plane 142. The absorbor 146 is for controlling the magnetization variation resulted from the increased current density. In general, the region with high current density usually locates on the central part of the system ground plate 142, so that the absorbor 146 can be, preferably but non-limitedly, disposed on the central region of the system ground plane 142. As for the mentioned handheld electronic device 10, using the electricity conduction plate 144 and the absorbor 146 further prevents the electromagnetic interference, thereby allowing the handheld electronic device 10 to be further complied with the HAC act established by FCC.

Figure 7A:
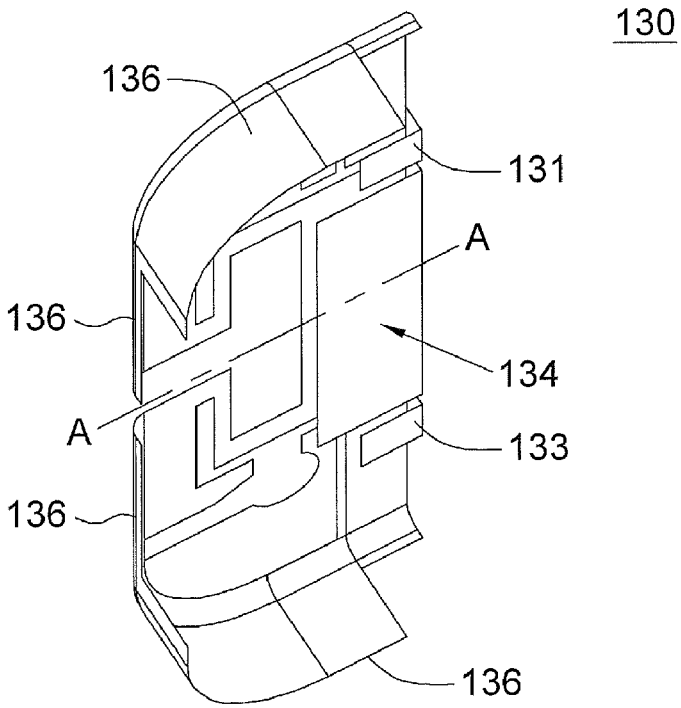
FIGS. 7A and 7B are schematic diagrams showing the three-dimensional architectures of the balance antenna at different angles.
Figure 7B:
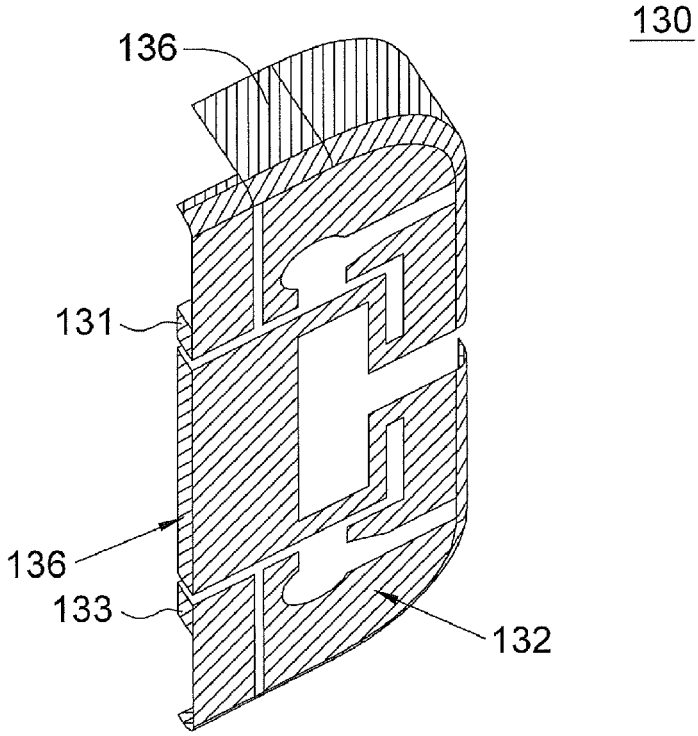

Referring to FIGS. 7A and 7B, FIGS. 7A and 7B are schematic diagrams showing the three-dimensional architectures of the balance antenna at different angles. As shown in FIG. 7B, shaded zones are further used to represent the antenna with practical pattern. The mentioned balance antenna 130 includes a radiator front side 132, a radiator rear side 134, and a radiator lateral side 136. The balance antenna 130 further includes a feed portion 131 and a ground portion 133, wherein the feed portion 131 and the ground portion 133 are electrically coupled to the body 140, respectively. Specifically, two extended strip-shape portions of the radiator front side 132 are bended toward the radiator rear side 134, so as to form the feed portion 131 and the ground portion 133 respectively. Each of the feed portion 131 and the ground portion 133 is electrically coupled to the body 140 through a respective spring finger. The radiator front side 132 and the radiator rear side 134 are parallel and opposite to each other. The radiator lateral side 136 is electrically coupled to the radiator front side 132 and the radiator read side 134, and is perpendicular to the radiator front side 132 and the radiator rear side 134. The mobile communication device is usually requested to be of light weight, thin thickness, small size and micro feature, so that the conventional balance antenna was not widely applied in the mobile communication device due to its considerable size. As shown in FIGS. 7A and 7B, the balance antenna 130 is embodied with a folded form, so as to reduce its required current path (a.k.a. a radiation resonance path that wireless signal requires when the handheld electronic device is operated at certain frequency.) In this way, the balance antenna 130 can be disposed in the handheld electronic device 10, forming a bilateral symmetry structure along a central axis of the Intercept A-A. Furthermore, the balance antenna 130 can be a loop antenna. In this way, the current flowing into the balance antenna 130 is equal to the current flowing out of the balance antenna 130, thereby further preventing the induced current from being generated on the substrate, and greatly improving the electromagnetic interference for the handheld electronic device 10.

The mobile communication device according to the present embodiments of the application has a number of advantages, some of which are listed as follows:

1. the induced current on the substrate can be reduced; and
2. HAC act can be complied with.

While the application has been described by way of example and in terms of a preferred embodiment, it is to be understood that the application is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A handheld electronic device, comprising:
a housing having a top end and a bottom end;
a receiver located in the housing and near the top end;
a balance antenna located in the housing and near the bottom end, a current flowing into the balance antenna being equal to a current flowing out of the balance antenna, the balance antenna being a loop antenna, the loop antenna firming a symmetrical structure of three-dimensions, and comprising:
a first radiator;
a second radiator parallel and opposite to the first radiator; and
a third radiator connected to the first radiator and the second radiator, and being perpendicular to the first radiator and the second radiator, respectively; and
a body located in the housing and being electrically coupled to the receiver and the balance antenna.

2. The handheld electronic device according to claim 1, wherein the balance antenna is located between the housing and the body.

3. The handheld electronic device according to claim 1, wherein two extended strip-shape portions of the first radiator are bended toward the second radiator so as to form a feed portion and a ground portion, and the feed portion and the ground portion are electrically coupled to the body, respectively.

4. The handheld electronic device according to claim 1, wherein the body further comprises:

a ground plane electrically coupled to the balance antenna; and an electricity conduction plate electrically coupled to the ground plane and near the top end.

5. The handheld electronic device according to claim 4, further comprising:

an absorber for controlling the magnetization variation esulted from the increased current density.

6. The handheld electronic device according to claim 5, wherein the absorber is disposed on the central region of the ground plane.

7. The handheld electronic device according to claim 1, wherein the balance antenna is folded within the housing.

8. The handheld electronic device according to claim 1, wherein the third radiator is bent outwards at the bottom end to fit the edge of the housing.

* * * * *